US008879756B2

(12) United States Patent
Kim

(10) Patent No.: US 8,879,756 B2
(45) Date of Patent: Nov. 4, 2014

(54) VOICE FILM OF MULTI-LAYERED STRUCTURE FOR FLAT TYPE SPEAKER

(75) Inventor: Dongman Kim, Seoul (KR)

(73) Assignee: Exelway Inc., Seoul (KR)

( * ) Notice: Subject to any disclaimer, the term of this patent is extended or adjusted under 35 U.S.C. 154(b) by 17 days.

(21) Appl. No.: 13/703,452

(22) PCT Filed: Jun. 7, 2011

(86) PCT No.: PCT/KR2011/004145

§ 371 (c)(1),
(2), (4) Date: Dec. 11, 2012

(87) PCT Pub. No.: WO2011/155750

PCT Pub. Date: Dec. 15, 2011

(65) Prior Publication Data

US 2013/0089232 A1 Apr. 11, 2013

(30) Foreign Application Priority Data

Jun. 11, 2010 (KR) ..... 10-2010-0055203

(51) Int. Cl.
*H04R 25/00* (2006.01)

(52) U.S. Cl.
USPC ..... 381/152; 381/176; 381/399; 381/431

(58) Field of Classification Search
USPC ..... 381/152, 173–176, 190–191, 399, 431
See application file for complete search history.

(56) References Cited

U.S. PATENT DOCUMENTS 7,337,453 B2 * 2/2008 Kang et al. ..... 720/685
2008/0247572 A1 * 10/2008 Langereis et al. ..... 381/174

* cited by examiner

*Primary Examiner* — Suhan Ni
(74) *Attorney, Agent, or Firm* — Occhiuti & Rohlicek LLP

(57) ABSTRACT

The present invention relates to a voice film having a multi-layered structure for a flat panel speaker, including a PCB configured to have permanent magnets disposed on the left and right sides thereof, to have a voice coil patterned therein and disposed between the permanent magnets on the left and right sides so that the voice coil is vibrated up and down, and to have a PCB structure of a stack structure and coil patterns formed on surfaces of the highest PCB, one or more intermediate layer PCBs, and the lowest PCB in the form of a consecutive spiral track, wherein the start points of coil patterns of adjacent PCBs formed in layers, from among the coil patterns, are shorted through a via hole and are bonded to the respective end points of the coil patterns of the adjacent PCBs at the end points of the coil patterns.

10 Claims, 3 Drawing Sheets

VOICE FILM OF MULTI-LAYERED STRUCTURE FOR FLAT TYPE SPEAKER

CROSS REFERENCE TO RELATED APPLICATION

This application is the National Stage of International Application No. PCT/KR2011/004145, filed on Jun. 7, 2011, which claims the benefit of Korean Patent Application No. 10-201-55203, filed Nov. 6, 2010. The content of these applications is hereby incorporated by reference in its entirety.

BACKGROUND OF THE INVENTION

1. Technical Field

The present invention relates generally to a flat panel type speaker and, more particularly, to a voice film for a flat panel type speaker having a multi-layered structure.

2. Description of the Related Art

A speaker includes a voice coil and a diaphragm interposed between magnets and generates a sound by a diaphragm that is vibrated when the voice coil moves.

The voice coil includes a circular voice coil and a straight type voice coil. The circular voice coil is used in a common circular speaker.

The straight type voice coil is shown in FIGS. 1 and 2. As shown in FIGS. 1 and 2, the straight type voice coil is wound in an elliptical form or printed in a pattern on one side or both sides of each of coil bases 11 and 21 each having a plate form.

The straight type voice coil of a winding form is wound over most of the regions of the coil base 11 or 21. If the coil base is ultra-small or large, some tension is generated and it is difficult o wind the straight type voice coil at a uniform interval. A difference between the tensions generates a difference between the resistances of internal coils, thereby becomes a deteriorating factor to generate a uniform sound.

For this reason, a straight type voice coil of a printed pattern form has recently been developed.

A conventional voice coil of a printed pattern form, however, is problematic in that it is difficult to apply to a high-capacity flat panel type speaker because a pattern is formed on one side or both sides of one Printed Circuit Board (PCB) and thus induced electromotive force cannot be increased.

SUMMARY OF THE INVENTION

Accordingly, the present invention has been made keeping in mind the above problems occurring in the prior art, and an object of the present invention is to provide the voice film of a multi-layered structure for a flat panel speaker which can be used in a high-capacity speaker by increasing the number of turns of a coil or the magnetic flux density of the coil using a stack type PCB in order to increase the intensity of induced electromotive force.

In an aspect of the present invention, a voice film having a multi-layered structure for a flat panel speaker includes a PCB configured to have permanent magnets disposed on the left and right sides thereof, to have a voice coil patterned therein and disposed between the permanent magnets on the left and right sides so that the voice coil is vibrated up and down, and to have a PCB structure of a stack structure and coil patterns formed on surfaces of the highest PCB, one or more intermediate layer PCBs, and the lowest PCB in the form of a consecutive spiral track, wherein the start points of coil patterns of adjacent PCBs formed in layers, from among the coil patterns, are shorted through a via hole and are bonded to the respective end points of the coil patterns of the adjacent PCBs at the end points of the coil patterns.

In another aspect of the present invention, a voice film having a multi-layered structure for a flat panel speaker includes a PCB configured to have permanent magnets disposed on the left and right sides thereof, to have a voice coil patterned therein and disposed between the permanent magnets on the left and right sides so that the voice coil is vibrated up and down, and to have a PCB structure of a stack structure and coil patterns formed on surfaces of the highest PCB, one or more intermediate layer PCBs, and the lowest PCB in the form of a consecutive spiral track, so that an N-degree (N is an integer) layer is formed, wherein the coil patterns are shorted through via holes at the start points of coil patterns by an N/2-degree layer between adjacent PCBs and are bonded to the respective end points of coil patterns formed in N/2-degree layers of other adjacent PCBs at the end points of the coil patterns.

In yet another aspect of the present invention, a voice film having a multi-layered structure for a flat panel speaker includes a PCB configured to have permanent magnets disposed on the left and right sides thereof, to have a voice coil patterned therein and disposed between the permanent magnets on the left and right sides so that the voice coil is vibrated up and down, and to have a PCB structure of a stack structure and coil patterns formed on surfaces of the highest PCB, one or more intermediate layer PCBs, and the lowest PCB in the form of a consecutive spiral track, so that an N-degree (N is an integer) layer is formed, wherein adjacent coil patterns of the coil patterns are shorted through via holes at the start points of the coil patterns in pairs and are bonded to the respective end points of coil patterns of adjacent another pair of PCBs at the end points of the coil patterns.

In further yet another aspect of the present invention, a voice film having a multi-layered structure for a flat panel speaker includes a PCB configured to have permanent magnets disposed on the left and right sides thereof, to have a voice coil patterned therein and disposed between the permanent magnets on the left and right sides so that the voice coil is vibrated up and down, and to have a PCB structure of a stack structure and coil patterns formed on surfaces of the highest PCB, one or more intermediate layer PCBs, and the lowest PCB in the form of a consecutive spiral track, so that an N-degree (N is an integer) layer is formed, wherein the start points of coil patterns formed in two or more PCBs, from among the coil patterns, are shorted through via holes at the start points of the coil patterns, and the end points of the coil patterns formed in the respective PCBs are bonded to the end points of coil patterns formed on other adjacent PCBs.

It is preferred that the PCB layer having the stack structure be a 4-degree or higher layer.

It is preferred that each of the coil patterns includes straight type pattern parts arranged in parallel and curved pattern parts each configured to couple the straight type pattern parts.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

The structures and acting effects of the voice films of multi-layered structures for flat panel speakers in accordance with some embodiments of the present invention are described below with reference to the accompanying drawings.

Figure 3:
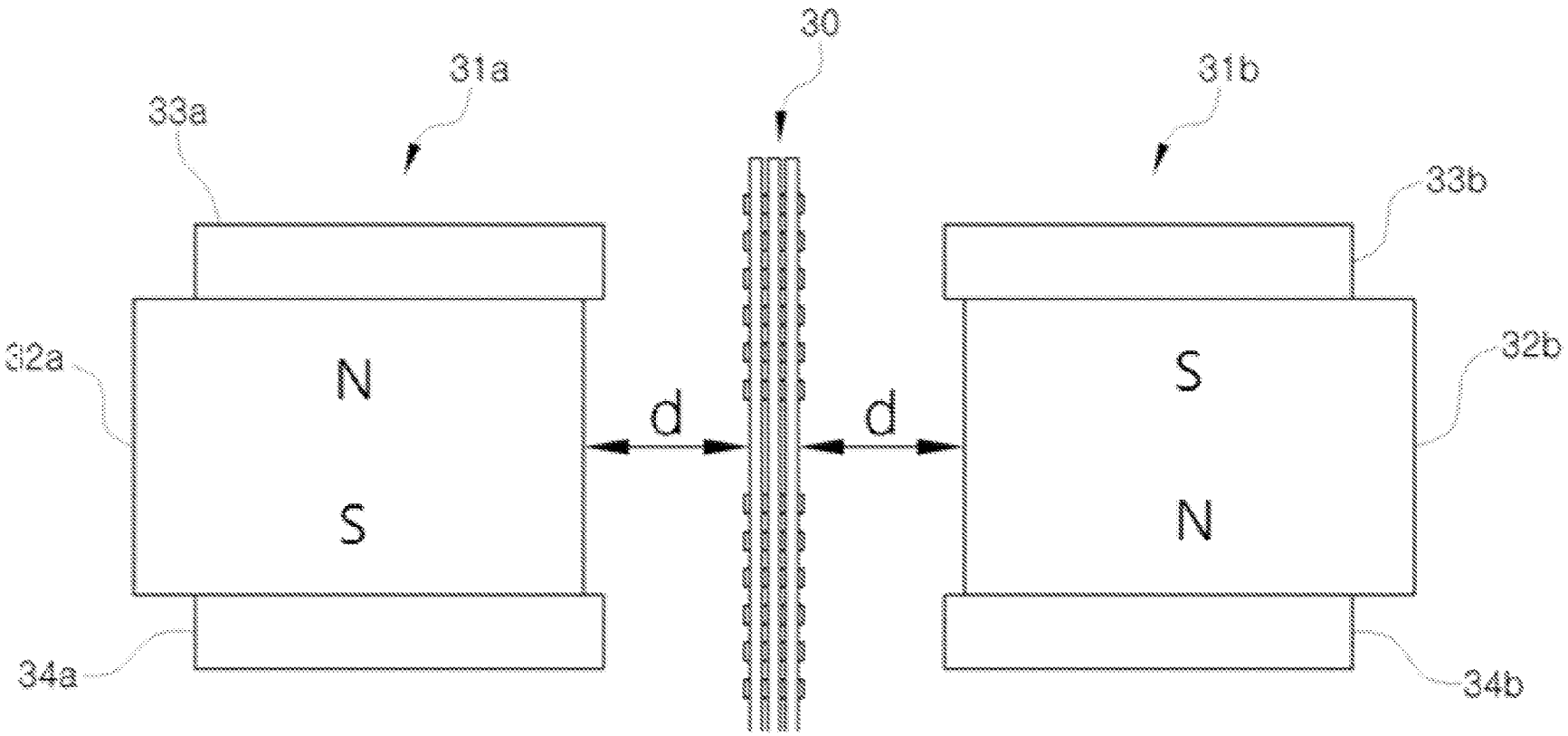
FIG. 3 is a schematic diagram showing a flat panel type speaker to which the voice film of a multi-layered structure for a flat panel speaker in accordance with the present invention is applied.

FIG. 3 is a schematic diagram showing a flat panel type speaker to which the voice film of a multi-layered structure for a flat panel speaker in accordance with the present invention is applied.

The flat panel type speaker to which the voice film of the present invention is applied is shown in FIG. 3. The flat panel type speaker includes a pair of magnetic bodies 31*a* and 31*b* spaced apart from each other at a specific interval and configured to face each other and a voice film 30 interposed between the pair of magnetic bodies 31*a* and 31*b*.

The pair of magnetic bodies 31*a* and 31*b* that face each other has the same construction and may have permanent magnets 32*a* and 32*b*, upper yorks 33*a* and 33*b* placed at the tops of the permanent magnets 32*a* and 32*b*, and lower yorks 34*a* and 34*b* placed at the bottom of the permanent magnets 32*a* and 32*b*, respectively.

The permanent magnets 32*a* and 32*b* included within the magnetic bodies 31*a* and 31*b* that face each other preferably have opposite polarities so that an attractive force is applied between the permanent magnets 32*a* and 32*b*. The voice film 30 preferably is spaced apart from each of the magnetic bodies 31*a* and 31*b* on both sides thereof at the same distance d so that the same magnetic force is applied to the voice film 30.

Figure 1:
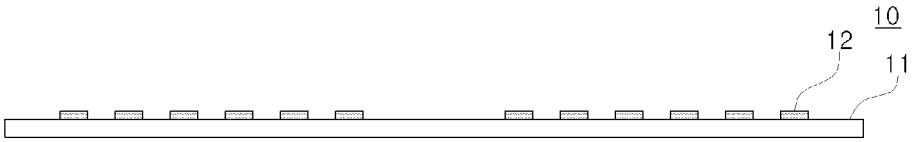
FIG. 1 shows an example of a cross section of a conventional voice film for a flat panel speaker.
Figure 2:
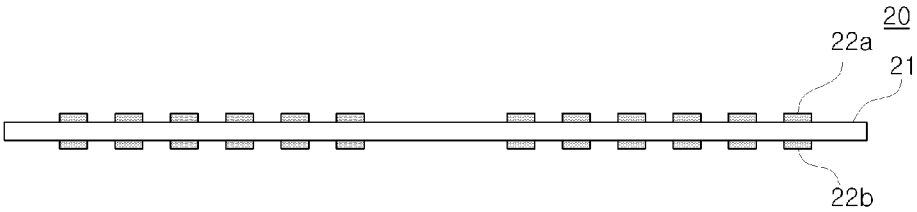
FIG. 2 shows another example of a cross section of a conventional voice film for a flat panel speaker.
Figure 4:
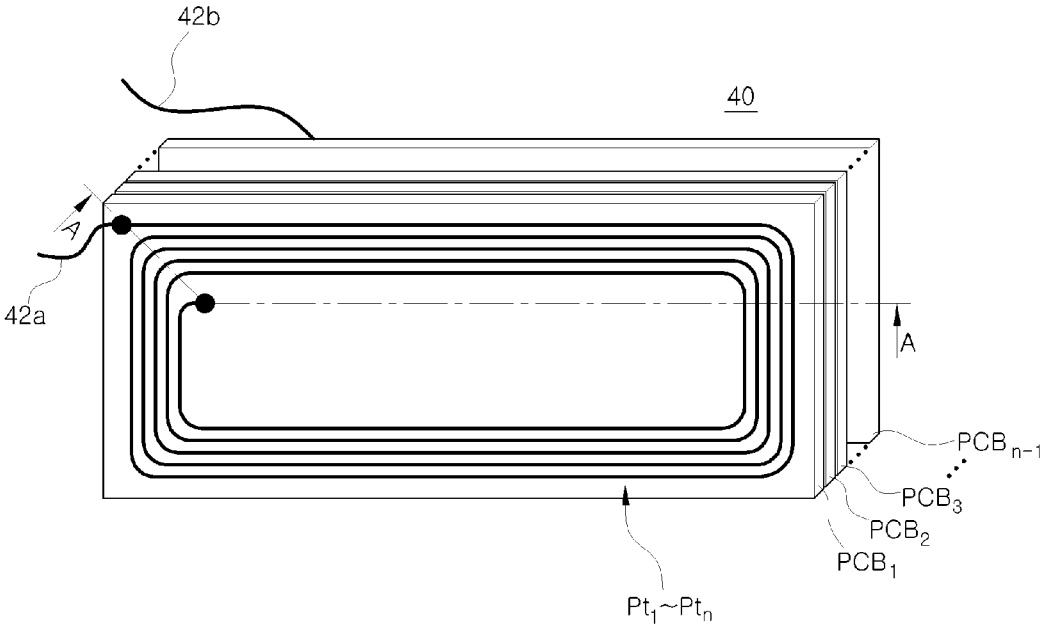
FIG. 4 is a perspective view of a voice film having a multi-layered structure for a flat panel speaker in accordance with the present invention.

FIG. 4 is a perspective view of a voice film having a multi-layered structure for a flat panel speaker in accordance with the present invention.

As shown in FIG. 4, the voice film 40 of a multi-layered structure in accordance with the present invention may include PCBs $PCB_1$ to $PCB_{n-1}$ and coil patterns $Pt_1$ to $Pt_n$. A first power source line 42*a* may be connected to the start point of the coil pattern $Pt_1$ of the highest PCB $PCB_1$, and a second power source line 42*b* can be connected to the end point of the coil pattern $Pt_n$ of the lowest PCB $PCB_{n-1}$.

The PCBs $PCB_1$ to $PCB_{n-1}$ are plates and may be made of insulating material, such as polyimide.

The coil patterns $Pt_1$ to $Pt_n$ may be formed on surfaces of the highest PCB $PCB_1$, the lowest PCB $PCB_{n-1}$, and the intermediate layer PCBs $PCB_2$ to $PCB_{n-2}$.

The coil patterns $Pt_1$ to $Pt_n$ are printed in a spiral track form, and they may have a plurality of straight-line pattern parts and a plurality of curved pattern parts which are not disconnected one another.

Furthermore, the coil patterns $Pt_1$ to $Pt_n$ may be formed to have a uniform line width or may be formed to have different line widths on a line that is symmetrical with a coil pattern formed on another surface although the coil patterns $Pt_1$ to $Pt_n$ are formed on the same surface. Here, the line width between the coil patterns may be changed by taking the area of the PCBs $PCB_1$ to $PCB_{n-1}$ and the magnetic force of the magnetic bodies into consideration.

The structures of the voice film 40 of a multi-layered structure shown in FIG. 4 in accordance with the present invention are described with reference to FIGS. 5 to 9 showing cross sections taken along line A-A.

Figure 5:
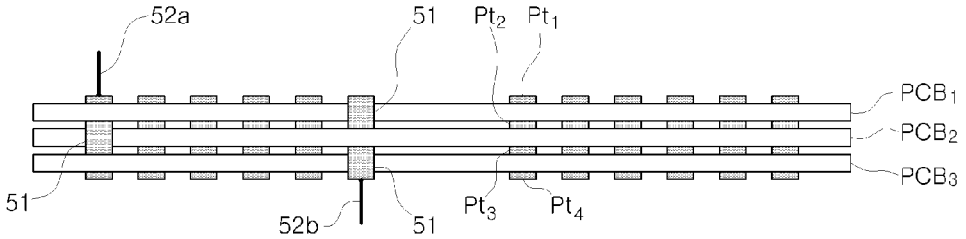
FIG. 5 is a cross-sectional view taken along line A-A of FIG. 4 and is a cross-sectional view of a voice film having a multi-layered structure for a flat panel speaker in accordance with a first embodiment of the present invention.

FIG. 5 is a cross-sectional view taken along line A-A of FIG. 4 and is a cross-sectional view of a voice film having a multi-layered structure for a flat panel speaker in accordance with a first embodiment of the present invention.

The first embodiment of the present invention relates to the cross-sectional view of a voice film having a 4-degree layer structure. The coil patterns $Pt_1$ to $Pt_4$ are formed from the start point of the coil pattern $Pt_1$ on a surface of the highest PCB $PCB_1$ to the end point of the coil pattern $Pt_4$ on a surface of the lowest PCB $PCB_3$ via an intermediate layer PCB $PCB_2$ (through a connection groove 51).

A first power source line 52*a* may be connected to the start point of the coil pattern $Pt_1$, and the second power source line 52*b* may be connected to the end point of the coil pattern $Pt_4$.

This structure may also be applied to a voice film having a PCB structure of 6 layers or higher. This structure is advantageous in that it can be applied to a high-capacity speaker because induced electromotive force can be increased by increasing the number of turns.

Figure 6:
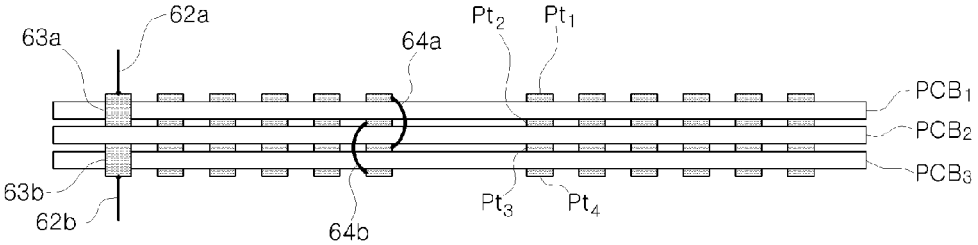
FIG. 6 is a cross-sectional view taken along line A-A of FIG. 4 and is a cross-sectional view of a voice film having a multi-layered structure for a flat panel speaker in accordance with a second embodiment (e.g., a 4-degree layer structure) of the present invention.
Figure 7:
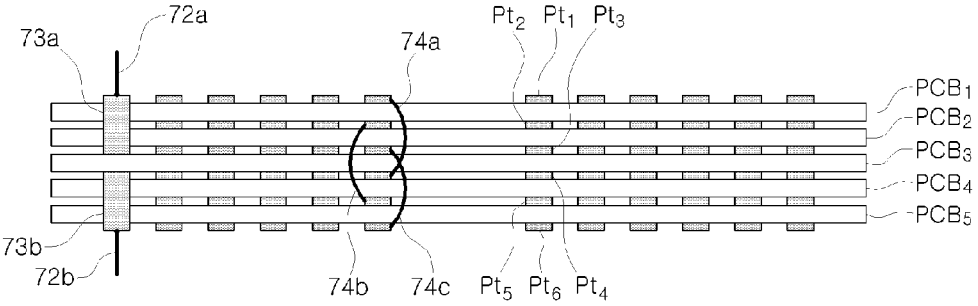
FIG. 7 is a cross-sectional view taken along line A-A of FIG. 4 and is a cross-sectional view of a voice film having a multi-layered structure for a flat panel speaker in accordance with the second embodiment (e.g., a 6-degree layer structure) of the present invention.

FIG. 6 is a cross-sectional view taken along line A-A of FIG. 4 and is a cross-sectional view of a voice film having a multi-layered structure for a flat panel speaker in accordance with a second embodiment (e.g., a 4-degree layer structure) of the present invention, and FIG. 7 is a cross-sectional view taken along line A-A of FIG. 4 and is a cross-sectional view of a voice film having a multi-layered structure for a flat panel speaker in accordance with the second embodiment (e.g., a 6-degree layer structure) of the present invention.

The second embodiment of the present invention of FIGS. 6 and 7 has a structure in which coil patterns are shorted by an N/2 degree and coil patterns are bonded in a voice film having an N-degree (N is an integer) layer structure.

FIG. 6 is a cross-sectional view of the voice film having a 4-degree layer structure (including 3 PCBs $PCB_1$ to $PCB_3$). Coil patterns $Pt_1$ and $Pt_2$ are shorted through via holes 63*a* and 63*b* at the start point of the pattern, and likewise the coil patterns $Pt_3$ and $Pt_4$ are shorted through the via holes at the start point of the coil pattern. The end point of the first coil pattern $Pt_1$ is bonded (64*a*) to the end point of the third coil pattern $Pt_3$, and the end point of the second coil pattern $Pt_2$ is bonded (64*b*) to the end point of the fourth coil pattern $Pt_4$.

A first power source line 62*a* may be connected to the start point of the first coil pattern $Pt_1$, and a second power source line 62*b* may be connected to the start point of the fourth coil pattern $Pt_4$.

FIG. 7 is a cross-sectional view of the voice film having a 6-degree layer structure (including 5 PCBs $PCB_1$ to $PCB_5$). Coil patterns $Pt_1$ to $Pt_3$ are shorted through a via hole 73*a* at the start point of the coil pattern, and likewise coil patterns $Pt_4$ to $Pt_6$ are shorted through a via hole 73*b* at the start point of the coil pattern. The end point of the first coil pattern $Pt_1$ is bonded (74*a*) to the end point of the fourth coil pattern $Pt_4$, and the end point of the second coil pattern $Pt_2$ is bonded (74*b*) to the end point of the fifth coil pattern $Pt_5$, and the end point of the third coil pattern $Pt_3$ is bonded (74*c*) to the end point of the sixth coil pattern $Pt_6$.

A first power source line 72*a* may be connected to the start point of the first coil pattern $Pt_1$, and the second power source line 72*b* may be connected to the start point of the sixth coil pattern $Pt_6$.

This structure may also be applied to a voice film having a PCB structure of 8 layers or higher. This structure is advantageous in that it can be applied to a high-capacity speaker because induced electromotive force can be increased by increasing the number of turns.

Figure 8:
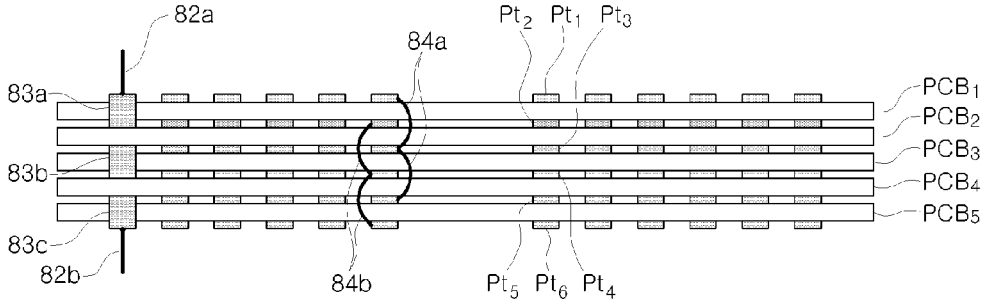
FIG. 8 is a cross-sectional view taken along line A-A of FIG. 4 and is a cross-sectional view of a voice film having a multi-layered structure for a flat panel speaker in accordance with a third embodiment (e.g., a 6-degree layer structure) of the present invention.

FIG. 8 is a cross-sectional view taken along line A-A of FIG. 4 and is a cross-sectional view of a voice film having a multi-layered structure for a flat panel speaker in accordance with a third embodiment (e.g., a 6-degree layer structure) of the present invention.

FIG. 8 is a cross-sectional view of the voice film having a 6-degree layer structure (including 5 PCBs $PCB_1$ to $PCB_5$). Coil patterns $Pt_1$ to $Pt_6$ are shorted in pair (e.g., $Pt_1$ and $Pt_2$) through via holes 83*a*, 83*b*, and 83*c* at the start point of the coil pattern, the end points of the first, third, and fifth coil patterns $Pt_1$, $Pt_3$, and $Pt_5$ are bonded together (84*a*), and the end points of the second, fourth, and sixth coil patterns $Pt_2$, $Pt_4$, and $Pt_6$ are bonded together (84*b*).

A first power source line 82*a* may be connected to the start point of the first coil pattern $Pt_1$, and a second power source line 82*b* may be connected to the start point of the sixth coil pattern $Pt_6$.

This structure may also be applied to a voice film having a PCB structure of 8 layers or higher. This structure is advantageous in that it can be applied to a high-capacity speaker because induced electromotive force can be increased by increasing the number of turns.

Figure 9:
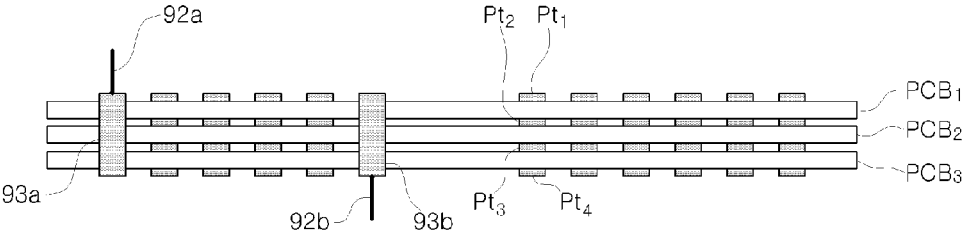
FIG. 9 is a cross-sectional view taken along line A-A of FIG. 4 and is a cross-sectional view of a voice film having a multi-layered structure for a flat panel speaker in accordance with a fourth embodiment (e.g., a 4-degree layer structure) of the present invention.

FIG. 9 is a cross-sectional view taken along line A-A of FIG. 4 and is a cross-sectional view of a voice film having a multi-layered structure for a flat panel speaker in accordance with a fourth embodiment (e.g., a 4-degree layer structure) of the present invention.

FIG. 9 is a cross-sectional view of the voice film having a 4-degree layer structure (including 3 PCBs $PCB_1$ to $PCB_3$). All coil patterns $Pt_1$ to $Pt_4$ are shorted through a via hole 93*a* at the start point of the pattern and are bonded through a via hole 93*b* at the end point of the pattern of the coil patterns $Pt_1$ to $Pt_4$.

A first power source line 92*a* may be connected to the start point of the shorted coil pattern, and the second power source line 92*b* may be connected to the end point of the bonded coil pattern.

The embodiment of FIG. 9 illustrates that all the coil patterns $Pt_1$ to $Pt_4$ are shorted, but the construction of the present invention can be embodied by shorting the first and fourth layers directly without shorting the second and third layers according to circumstances.

This structure may also be applied to a voice film having a PCB structure of 6 layers or higher. This structure is advantageous in that it can have the same performance as that when a Litz wire is wound and it can be applied to a high-capacity speaker because induced electromotive force can be increased by increasing the number of turns.

In accordance with the constructions of the present invention, there can be provided a voice film having a multi-layered structure for a flat panel speaker which can be used in a high-capacity speaker by increasing the number of turns of a coil or the magnetic flux density of the coil using a stack type PCB in order to increase the intensity of induced electromotive force.

While some embodiments of the invention have been described with reference to the accompanying drawings, it will be understood that those skilled in the art can implement the technical construction of the present invention in various forms without departing from the technical spirit or indispensable characteristics of the present invention. Accordingly, the above embodiments should be construed to be illustrative and should not be limitative from all aspects. Furthermore, the scope of the present invention is defined by the appended claims rather than the above detailed description. The present invention should be construed to cover all modifications or variations induced from the meanings and scope of the appended claims and their equivalents.

What is claimed is:

1. A multi-layered voice film for a flat panel speaker comprising:

a Printed Circuit Board (PCB) structure including a stack structure of a highest PCB, one or more intermediate layer PCBs, and a lowest PCB, coil patterns of a consecutive spiral track form are formed on surfaces of the highest PCB, one or more of the intermediate layer PCBs, and the lowest PCB, and the coil patterns formed in each layer are bonded together through a via hole of an adjacent PCB.

2. The multi-layered voice film according to claim 1, wherein the PCB layer having the stack structure is a 4-degree or higher layer.

3. The multi-layered voice film according to claim 1, wherein each of the coil patterns comprises:

straight type pattern parts arranged in parallel, and curved pattern parts each configured to couple the straight type pattern parts.

4. The multi-layered voice film according to claim 1, wherein a start point of the coil pattern of the highest PCB is connected to a first power source line, and an end point of the coil pattern of the lowest PCB is connected to a second power source line.

5. A multi-layered voice film for a flat panel speaker comprising:

a Printed Circuit Board (PCB) structure of a stack structure of a highest PCB, one or more intermediate layer PCBs, and a lowest PCB, coil patterns formed on surfaces of the highest PCB, one or more of the intermediate layer PCBs, and the lowest PCB in a consecutive spiral track form, so that an N-degree (N is an integer) layer is formed, wherein the coil patterns are shorted through via holes at start points of coil patterns by an N/2-degree layer between adjacent PCBs and are bonded to respective end points of coil patterns formed in N/2-degree layers of other adjacent PCBs at the end points of the coil patterns.

6. The multi-layered voice film according to claim 5, wherein the PCB layer having the stack structure is a 4-degree or higher layer.

7. A multi-layered voice film for a flat panel speaker comprising:

a Printed Circuit Board (PCB) structure of a stack structure of a highest PCB, one or more intermediate layer PCBs, and a lowest PCB, coil patterns formed on surfaces of the highest PCB, one or more of the intermediate layer PCBs, and the lowest PCB in a consecutive spiral track form, so that an N-degree (N is an integer) layer is formed, wherein adjacent coil patterns of the coil patterns are shorted through via holes at start points of the coil patterns in pairs and are bonded to respective end points of coil patterns of adjacent another pair of PCBs at the end points of the coil patterns.

8. The multi-layered voice film according to claim 7, wherein the PCB layer having the stack structure is a 4-degree or higher layer.

9. A multi-layered voice film for a flat panel speaker comprising:

a Printed Circuit Board (PCB) structure of a stack structure of a highest PCB, one or more intermediate layer PCBs, and a lowest PCB, coil patterns formed on surfaces of the highest PCB, one or more of the intermediate layer PCBs, and the lowest PCB in a consecutive spiral track form, so that an N-degree (N is an integer) layer is formed, wherein start points of coil patterns formed in two or more PCBs, from among the coil patterns, are shorted through via holes at start points of the coil patterns, and end points of the coil patterns formed in the respective PCBs are bonded to end points of coil patterns formed on other adjacent PCBs.

10. The multi-layered voice film according to claim 9, wherein the PCB layer having the stack structure is a 4-degree or higher layer.

* * * * *